US005664267A

United States Patent [19]

Cheng

[11] Patent Number: 5,664,267

[45] Date of Patent: Sep. 9, 1997

[54] BASE OF A COLLAPSIBLE BABY PLAYING BED

[75] Inventor: Ying-Hsiung Cheng, Tainan Hsien, Taiwan

[73] Assignee: Top Fortune Ltd., San Diego, Calif.

[21] Appl. No.: 725,311

[22] Filed: Oct. 2, 1996

[51] Int. Cl.[6] ..... A47D 7/00

[52] U.S. Cl. ..... 5/99.1; 5/98.1

[58] Field of Search ..... 5/99.1, 98.1–98.3

[56] References Cited

U.S. PATENT DOCUMENTS

| | | | |
|---|---|---|---|
| 5,367,725 | 11/1994 | Tsai | 5/99.1 |
| 5,381,570 | 1/1995 | Cheng | 5/99.1 |
| 5,465,439 | 11/1995 | Chieng | 5/99.1 |
| 5,485,655 | 1/1996 | Wang | 5/99.1 |
| 5,504,951 | 4/1996 | Yeh | 5/99.1 |

*Primary Examiner*—Steven N. Meyers
*Assistant Examiner*—Tuyet-Phuong Pham
*Attorney, Agent, or Firm*—Morton J. Rosenberg; David I. Klein

[57] ABSTRACT

The base of a collapsible baby playing bed comprises four support rods which are pivoted to a respective corner support used to support the bed. Two connecting elements are arranged in the mediate portion of the base; each connecting element is pivoted to one of the support rods. The other two support rods which are not pivoted to the connecting elements are also connected with a respective one of the connecting elements. Two holders, two pivotal rods, two mediate rods and two mediate supports used to support the base are provided wherein the pivotal rods are pivoted to both the connecting elements and the mediate supports at two ends and the mediate rods are pivoted to the holders at one end and connected to the mediate support at the other end, and the support rods pivoted to the connecting elements are further connected to the holders such that the bed can be collapsed into a compact one after one pulls the base upward from the mediate portion thereof.

1 Claim, 6 Drawing Sheets

BASE OF A COLLAPSIBLE BABY PLAYING BED

BACKGROUND OF THE INVENTION

A heretofore known base structure of a collapsible baby playing bed was disclosed in U.S. Pat. No. 5,381,570, shown in FIG. 8.

This known collapsible baby playing bed is made to have various dimensions in order to be adapted for babies or children of different ages. However, when a base of this type of structure is made bigger to a certain degree, the base, when collapsed, is likely to project out of the range defined by the four corner legs resulting in the need for more space in storage and transportation.

SUMMARY OF THE INVENTION

The base of a collapsible baby playing bed comprises four support rods which are pivoted to a respective corner support used to support the bed. Two connecting elements are arranged in the mediate portion of the base.

Two of the support rods, which are substantially parallel to each other, are each passed through, and pivoted to a through hole of a respective connecting element and then fixedly connected to a respective holder; the other two of the support rods, which are also substantially parallel to each other, are each fixedly connected with a connecting portion of a respective connecting element.

Two pivotal rods, two mediate rods and two mediate supports, which are used to support the base, are provided; each pivotal rod is pivoted to a respective connecting element and a respective mediate support at two ends thereof; each mediate rod is pivoted to a respective holder at one end and connected to a respective mediate support at the other end. Thus, the base can be collapsed into a very compact one which will not protrude beyond the bed when the bed is collapsed.

BRIEF DESCRIPTION OF DRAWINGS

The invention will be better understood by reference to the accompany drawings, wherein.

DESCRIPTION OF THE PREFERRED EMBODIMENTS

Figure 1:
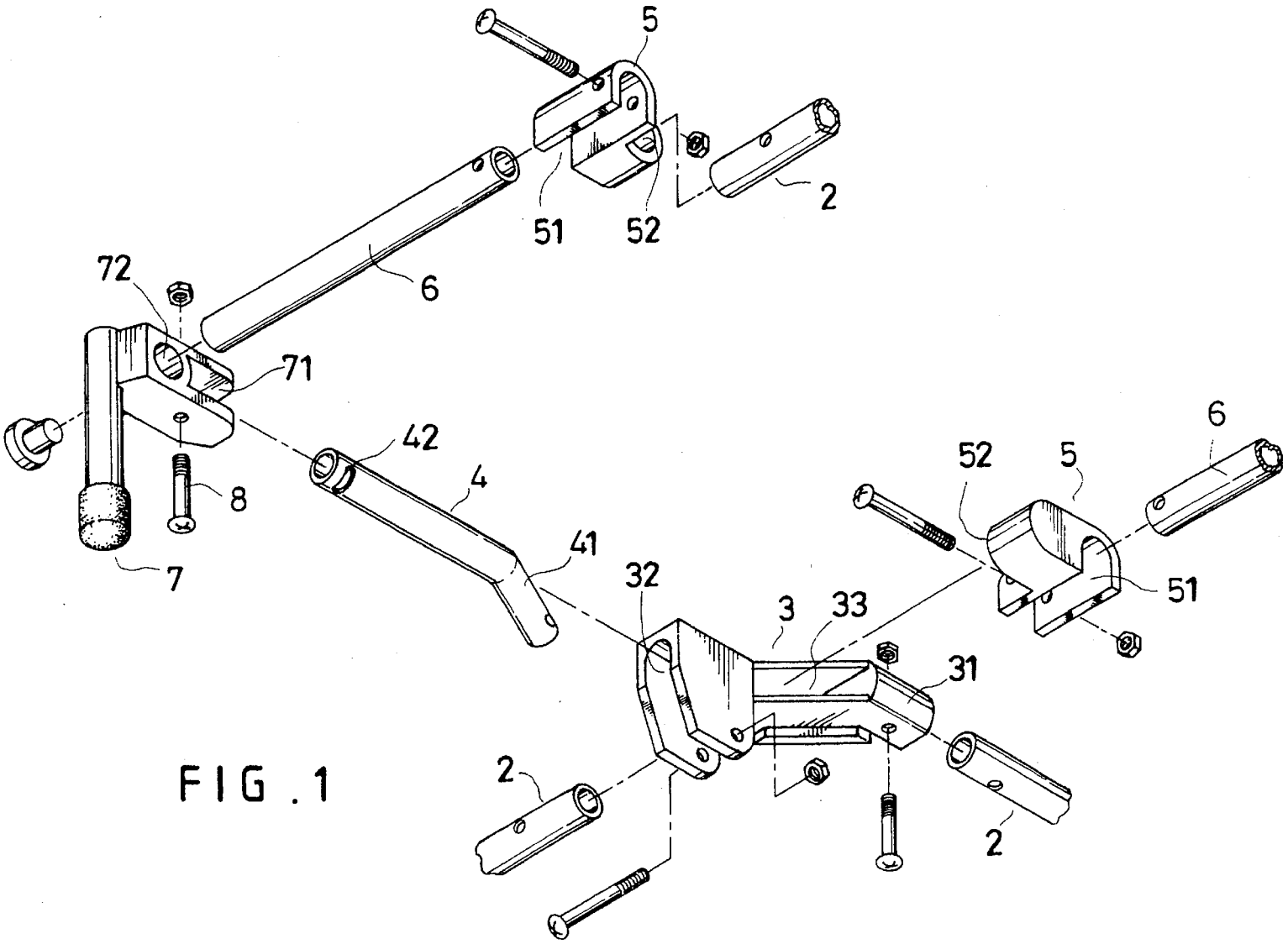
FIG. 1 is an exploded view of a portion of the base of the present invention.

A base of a collapsible baby playing bed according to the present invention is shown in FIGS. 1 to 7 and comprises four corner supports 1, two connecting elements 3, two pivotal rods 4, two holders 5, two mediate rods 6, two mediate supports 7, and four support rods 2 as the main parts.

Figure 2:
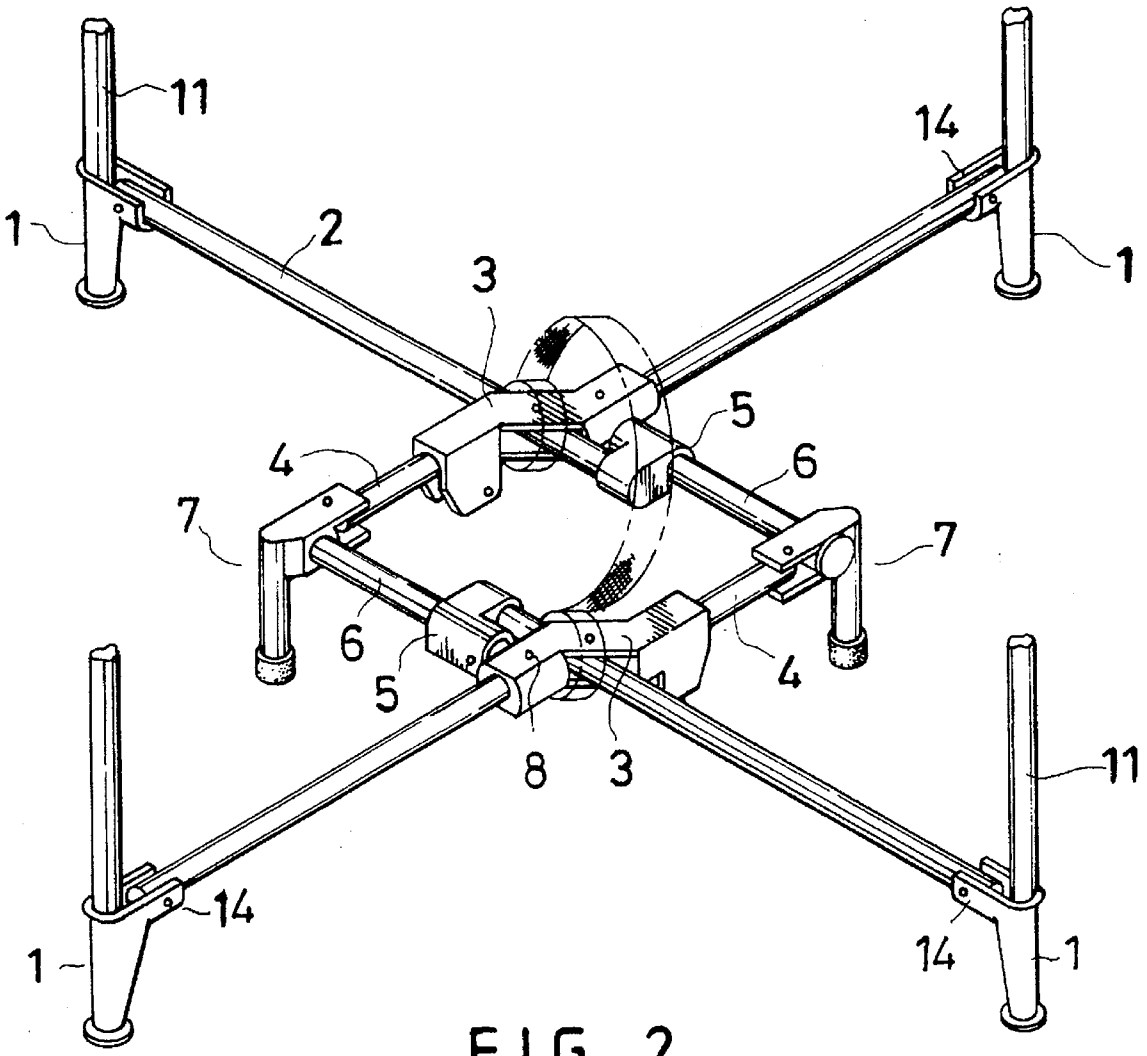
FIG. 2 is a view showing the base of the present invention in combination.
Figure 3:
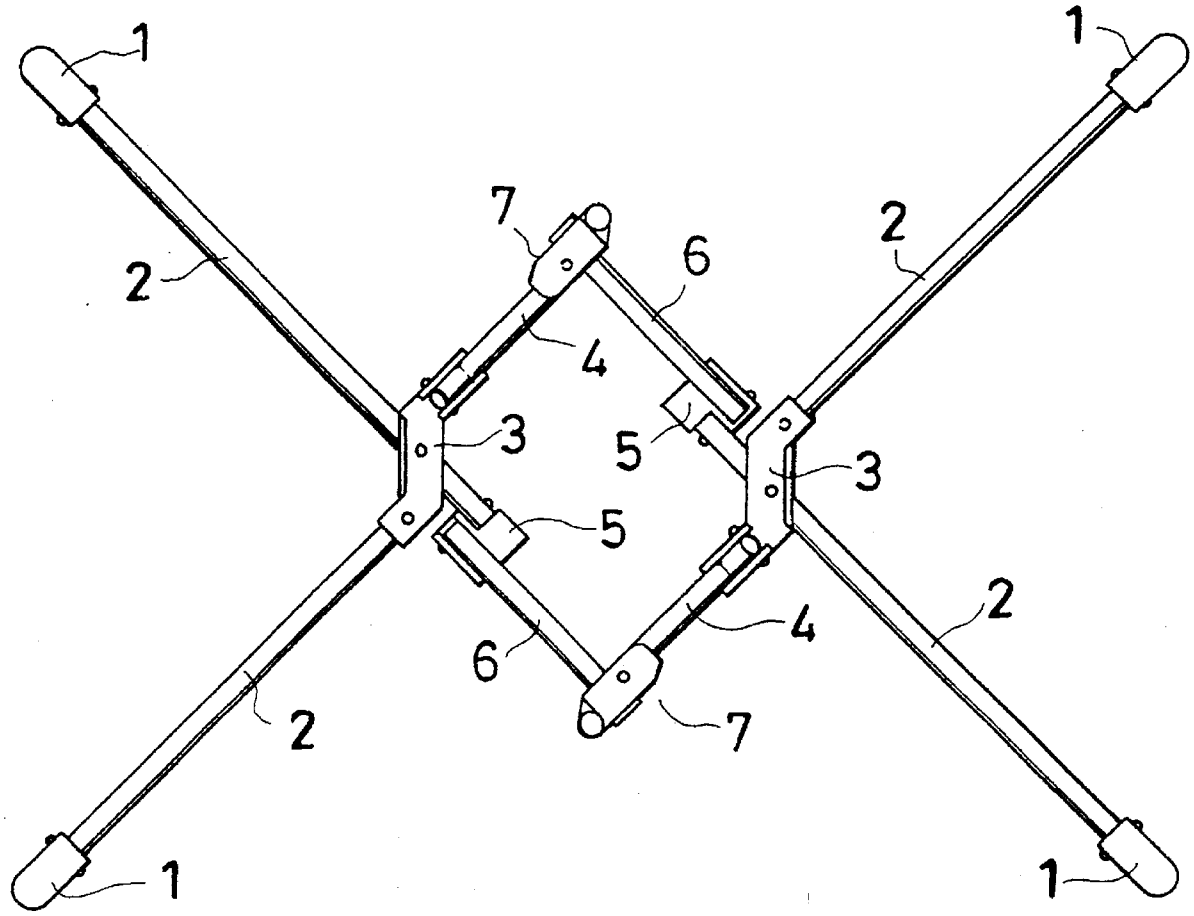
FIG. 3 is a bottom view of the base of the present invention in combination.
Figure 4:
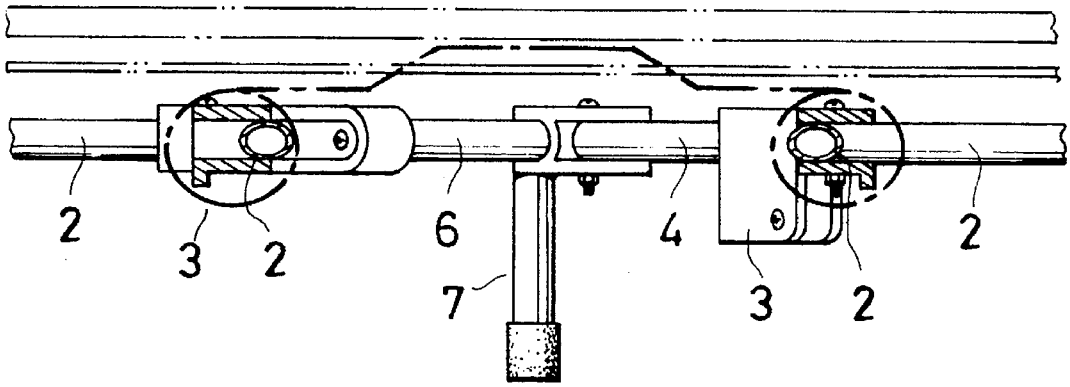
FIG. 4 is a side sectional view of a portion of the base of the present invention in combination.
Figure 5:
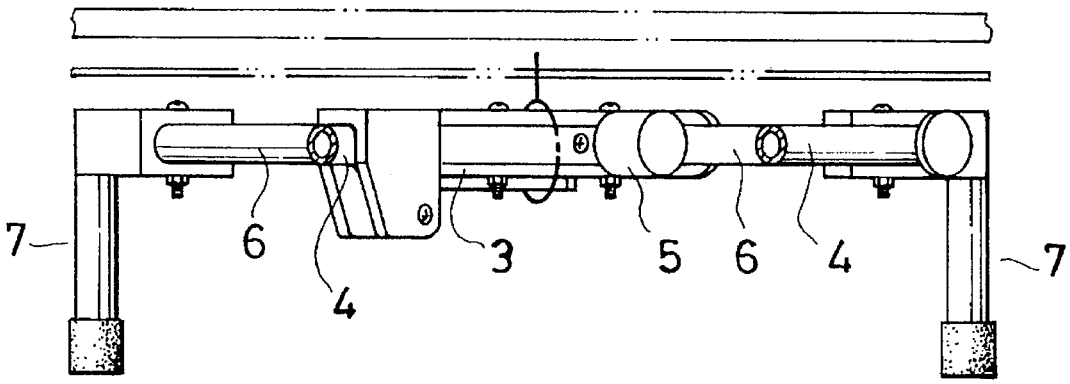
FIG. 5 is a front sectional view of a portion of the base of the present invention in combination.
Figure 6:
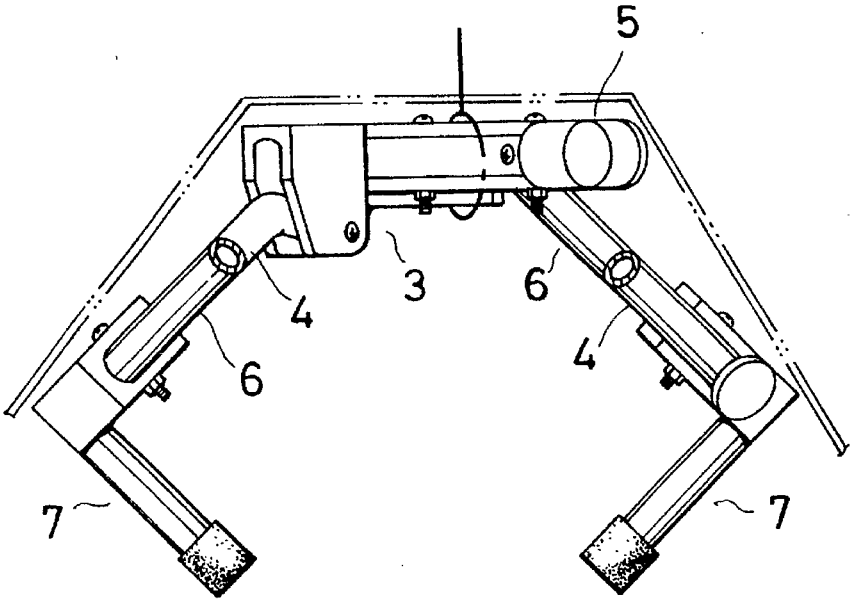
FIG. 6 is a view showing the pulling of the belt for collapsing the base according to the present invention.
Figure 7:
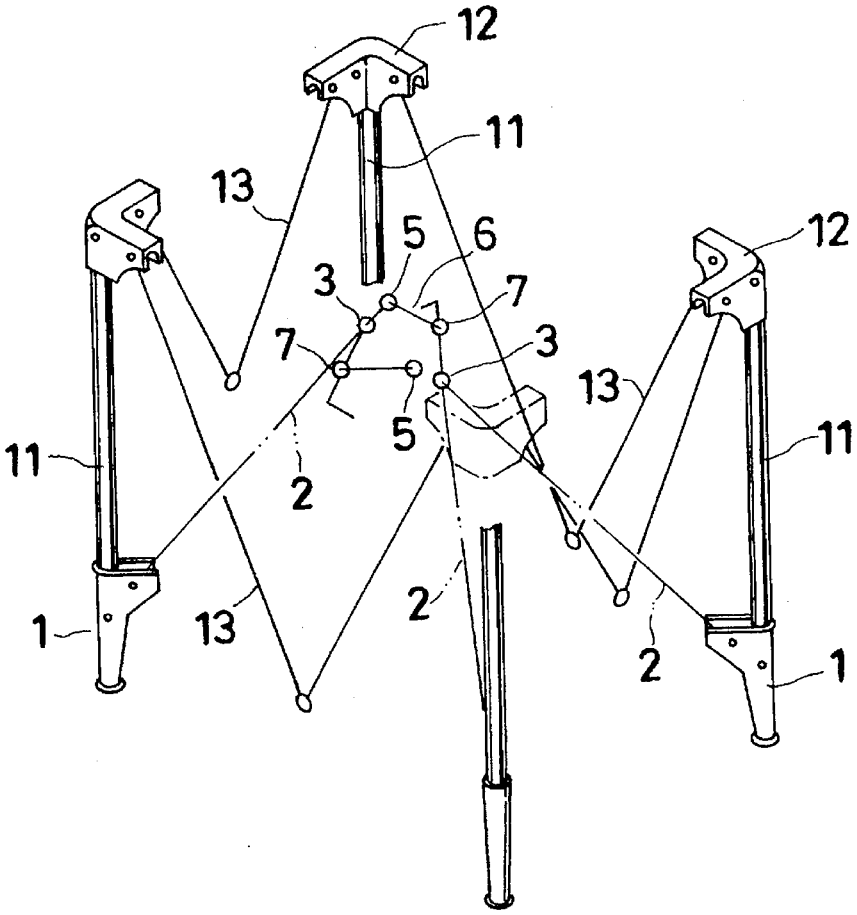
FIG. 7 is view showing the position of all the parts of the baby playing bed with the base of the present invention; and, FIG. 8 is a view of the prior art base of a baby playing bed.

Please now refer to FIGS. 1 and 2 for better understanding. Each corner support 1, is connected with a corner rod 11. The upper end of each corner rod 11 is connected with a corner connector 12 which is connected with a respective side rod 13, as shown in FIG. 7, to form an upper frame. Each corner support 1 further has a connecting end 14 for a respective one of the support rods 2 to be pivoted thereto.

Referring to FIGS. 1 and 2, the four support rods 2 are connected with the connecting elements 3 and the holders 5 at the ends opposite those pivoted to the corner support 1; two of the support rods 2, which are substantially parallel to each other, are each passed through, and pivoted to, a through hole 33 of a respective connecting element 3 and then fixedly connected to a hole 52 (FIG. 1) of a respective one of the holders 5; the other two of the support rods 2, which are also substantially parallel to each other, are each fixedly connected with a connecting portion 31 of a respective connecting element 3 by means of a screw 8.

Each connecting element 3 further has an opening 32 (FIG. 1).

Each pivotal rod 4 has a turned portion 41 and an elongate hole 42 (FIG. 1); each turned portion 41 is passed into, and pivoted to, an opening 32 of a respective connecting element 3.

Each mediate support 7 is provided to support the base and has a connecting opening 71 and a connecting hole 72 (FIG. 1). The elongate holes 42 of the pivotal rods 4 are each housed within, and pivoted to, a respective connecting opening 71.

Each holder 5 further has a U-shaped recessed part 51. Each U-shaped recessed part 51 is pivoted to one bored end of a respective mediate rod 6.

Each mediate rod 6 is further connected with a respective connecting hole 72 (FIG. 1) at the end opposite the bored end.

A pulling belt (FIG. 2) is connected to the connecting elements 3 and is used for the collapsing operation.

In the collapsing operation, the bed pad is removed and the pulling belt is pulled upward; thus, the pivotal rods 4, mediate rods 6 and mediate supports 7 move downward relative to the connecting elements 3 and the corner rods 11 move toward one another and gather with the collapsed base not projecting beyond the top of the bed, i.e. the corner connectors 14 connected to the corner rods 11.

From the above description, it can be understood the base of a collapsible baby playing bed has following advantages.

1. Because the collapsed base will not project beyond the uppermost portion of the collapsed bed, the space needed for storage and transportation is less than that needed in a prior art baby playing bed of the same dimension.

Figure 8:
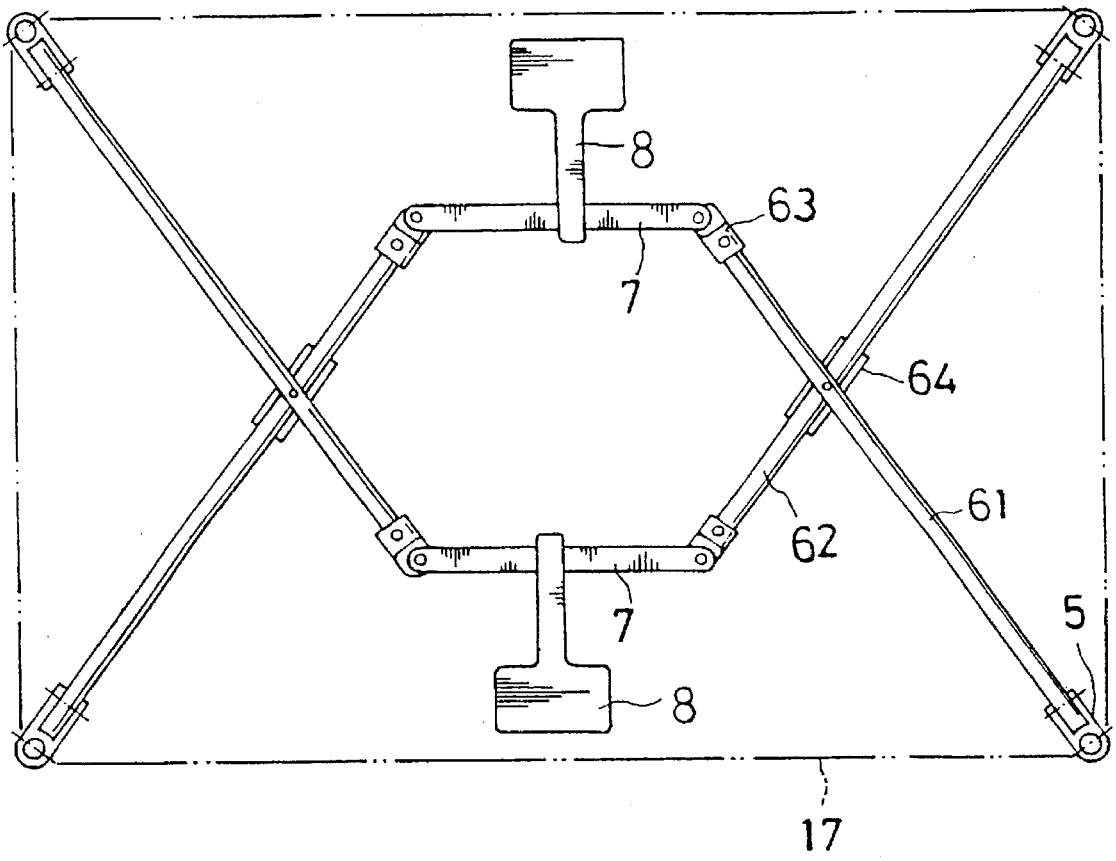
FIG. 8 (PRIOR ART)

2. The support rods are connected without using middle connecting elements (see element 7 of prior art FIG. 8) so only two mediate supports 7 are needed in the present base structure instead of four resulting in structure simplification without losing the stability of the base.

While the preferred embodiments of the invention have been described above, it will be recognized and understood that various modifications may be made therein and the appended claims are intended to cover all such modifications which may fall within the spirit and scope of the invention.

What is claimed is:

1. A base of a collapsible baby playing bed, in combination:

four corner supports, each corner support being connected with a corner rod of said bed and having a connecting end;

first and second connecting elements, each connecting element having a connecting portion, an opening and a through hole; two pivotal rods, each pivotal rod having a turned portion and an elongate hole, each turned portion being passed into and pivoted to a respective one of said openings of said connecting elements;

first and second holders, each holder having a hole and a U-shaped recessed part;

first and second mediate supports provided for supporting said base, each mediate support having a connecting opening and a connecting hole; each elongate hole of said pivotal rods being received within, and pivoted to, a respective said connecting opening;

first and second mediate rods, each mediate rod having a bored end pivoted to a respective said U-shaped recessed part of said holders and being connected to a respective said connecting hole of said mediate support;

a first support rod pivoted to said connecting end of said first corner support at a first end said first support rod being passed through said through hole of said first connecting element and connected to said hole of said first holder at one end opposite said first end thereof;

a second support rod, said second support rod being substantially parallel to said first support rod and being pivoted to said connecting end of said second corner support at a first end thereof, passed through, and pivoted to, said through hole of said second connecting element and connected to said hole of said second holder at one end opposite said first end thereof;

a third support rod pivoted to said connecting end of said third corner support at one end thereof, said third support rod being connected to said connecting portion of said first connecting element at one end opposite said first end thereof;

a forth support rod, said forth support rod being substantially parallel to said third support rod and being pivoted to said connecting end of said forth corner support at one end thereof and connected to said connecting portion of said second connecting element at one end opposite said first end thereof.

* * * * *